US007118393B1

(12) United States Patent
Pupkiewicz et al.

(10) Patent No.: US 7,118,393 B1
(45) Date of Patent: Oct. 10, 2006

(54) BONDED ELASTOMERIC CONNECTOR

(75) Inventors: Edward Joseph Pupkiewicz, Lansdale, PA (US); Bohdan Petro Wozniak, Warrington, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/199,400

(22) Filed: Aug. 8, 2005

(51) Int. Cl.
*H01R 4/58* (2006.01)

(52) U.S. Cl. ..... 439/91; 439/66

(58) Field of Classification Search ..... 439/91, 439/66, 591, 74, 86, 87
See application file for complete search history.

(56) References Cited

U.S. PATENT DOCUMENTS 4,534,602 A * 8/1985 Bley ..... 439/63
4,820,170 A * 4/1989 Redmond et al. ..... 439/66
4,922,191 A * 5/1990 Conover ..... 324/755
4,955,818 A * 9/1990 Strange et al. ..... 439/66
5,101,323 A * 3/1992 Prevost ..... 361/730
5,244,395 A * 9/1993 DeSantis et al. ..... 439/65
5,340,318 A * 8/1994 Kunihiro ..... 439/66
5,927,997 A * 7/1999 Ruland et al. ..... 439/31
6,636,058 B1 * 10/2003 Lyford ..... 324/754
6,685,487 B1 * 2/2004 Ward et al. ..... 439/91
6,752,639 B1 * 6/2004 Kirkman et al. ..... 439/91

* cited by examiner

*Primary Examiner*—Tulsidas C. Patel
*Assistant Examiner*—Vladimir Imas

(57) ABSTRACT

An electrical connector includes a holder configured to be mechanically and electrically connected to a circuit board. The holder has a surface that is at least partially conductive. A conductive elastomeric member is mounted in the holder and electrically connected to the at least partially conductive surface of the holder. The at least partially conductive surface is configured to convey electrical current between the elastomeric member and the circuit board.

20 Claims, 3 Drawing Sheets

BONDED ELASTOMERIC CONNECTOR

BACKGROUND OF THE INVENTION

The invention relates generally to electrical connectors and, more particularly, to a bonded elastomeric connector for making connections between substrates.

Many electronic applications utilize single contact connections to make a connection between substrates. For example, in a mobile phone application, a single contact connector may be used for making a grounding connection between two circuit boards. Typically, pogo pin type connectors or stamped and formed connectors are used for making such single contact connections. In addition, multiple pogo pin or stamped and formed connectors are often used to make connections to components such as speakers, ringers, or vibration motors and the like.

The aforementioned connector solutions have certain shortcomings, such as, for instance, they require custom tooling to manufacture and have long lead times. In particular, as electronic packages become progressively smaller, the size of the connectors must also become smaller and in many instances, the traditional connector designs become inadequate. In particular, there is a limit to how small a pogo pin connector can be made. Not only are there size limits for the pogo pin components, but at its limits, the deflection range becomes insufficient. In addition, the connector becomes even more costly as the size is reduced.

The aforementioned concerns have led to the increasing use of elastomeric connectors in electronic devices. The elastomer in the elastomeric connector maintains some of its flexibility even when reduced in size. One type of elastomeric connector includes alternating layers of a conductive and non-conductive elastomeric material such as silicon rubber, with the conductive layers formed with layers of silicon material impregnated with electrically conductive material such as carbon, gold, or silver, and the like. The non-conductive or dielectric elastomer layers are sandwiched between the conductive layers and are of sufficient thickness to insulate the conductive layers from one another.

It remains a challenge to provide a low profile low cost connector that is easily modified for multiple applications, that requires little tooling, and may be produced with short lead times.

BRIEF DESCRIPTION OF THE INVENTION

In one aspect, an electrical connector is provided. The connector includes a holder configured to be mechanically and electrically connected to a circuit board. The holder has a surface that is at least partially conductive. A conductive elastomeric member is mounted in the holder and electrically connected to the at least partially conductive surface of the holder. The at least partially conductive surface is configured to convey electrical current between the elastomeric member and the circuit board.

Optionally, the holder includes a pocket having a closed bottom and a side wall that has positioning ribs to locate the elastomeric member in the pocket. The holder is fabricated from a nonconductive platable material that is at least partially plated with a conductive material to provide a surface that is at least partially conductive. The holder may be stamped and formed from a metal material. The holder includes a receiving area open to an upper surface of the holder to receive an adhesive. The elastomeric member is bonded to the holder. The elastomeric member includes a plurality of conductive layers and nonconductive layers in an alternating arrangement. The bottom of the pocket and the side wall around the pocket of the holder are conductive. The conductive layers electrically engage at least one of the bottom and the side wall.

In another aspect, an electrical connector is provided that includes a holder configured to be mechanically connected to a circuit board. The holder includes a pocket having a relief area formed therein. A conductive elastomeric member is mounted in the pocket. The relief area facilitates deflection of the elastomeric member within the pocket.

DETAILED DESCRIPTION OF THE INVENTION

Figure 1:
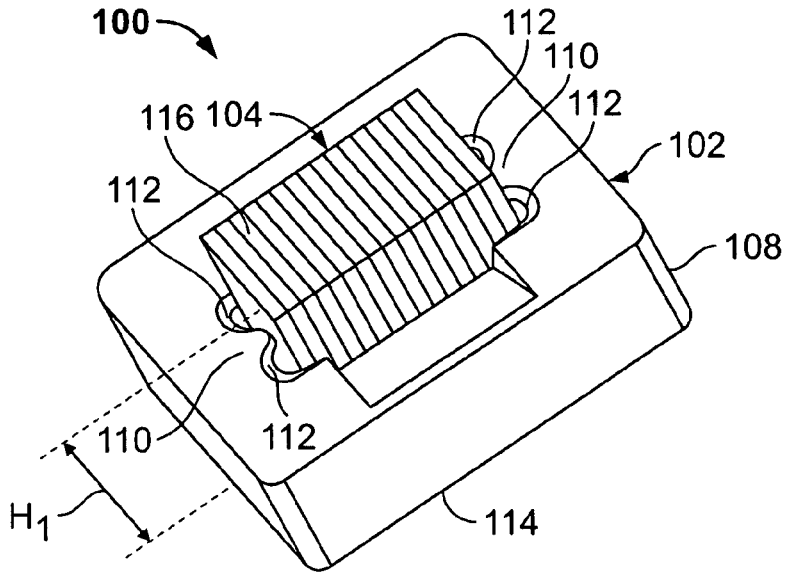
FIG. 1 is a perspective view of a bonded elastomeric connector formed in accordance with an exemplary embodiment of the present invention.

FIG. 1 is a perspective view of a bonded elastomeric connector 100 formed in accordance with an exemplary embodiment of the present invention. The connector 100 includes a holder 102 and an elastomeric member 104. The holder 102 includes a body 108 that is formed with positioning ribs 110 and relief areas 112. The elastomeric member 104 is mounted in the holder 102 between the positioning ribs 110. In the illustrated assembled connector 100, the elastomeric member 104 is bonded to the holder 102 forming an integrated assembly. The connector 100 has an overall height $H_1$ from a first mating surface at a base 114 of the holder 102 to an upper contact surface 116 of the elastomeric member 104.

Figure 2:
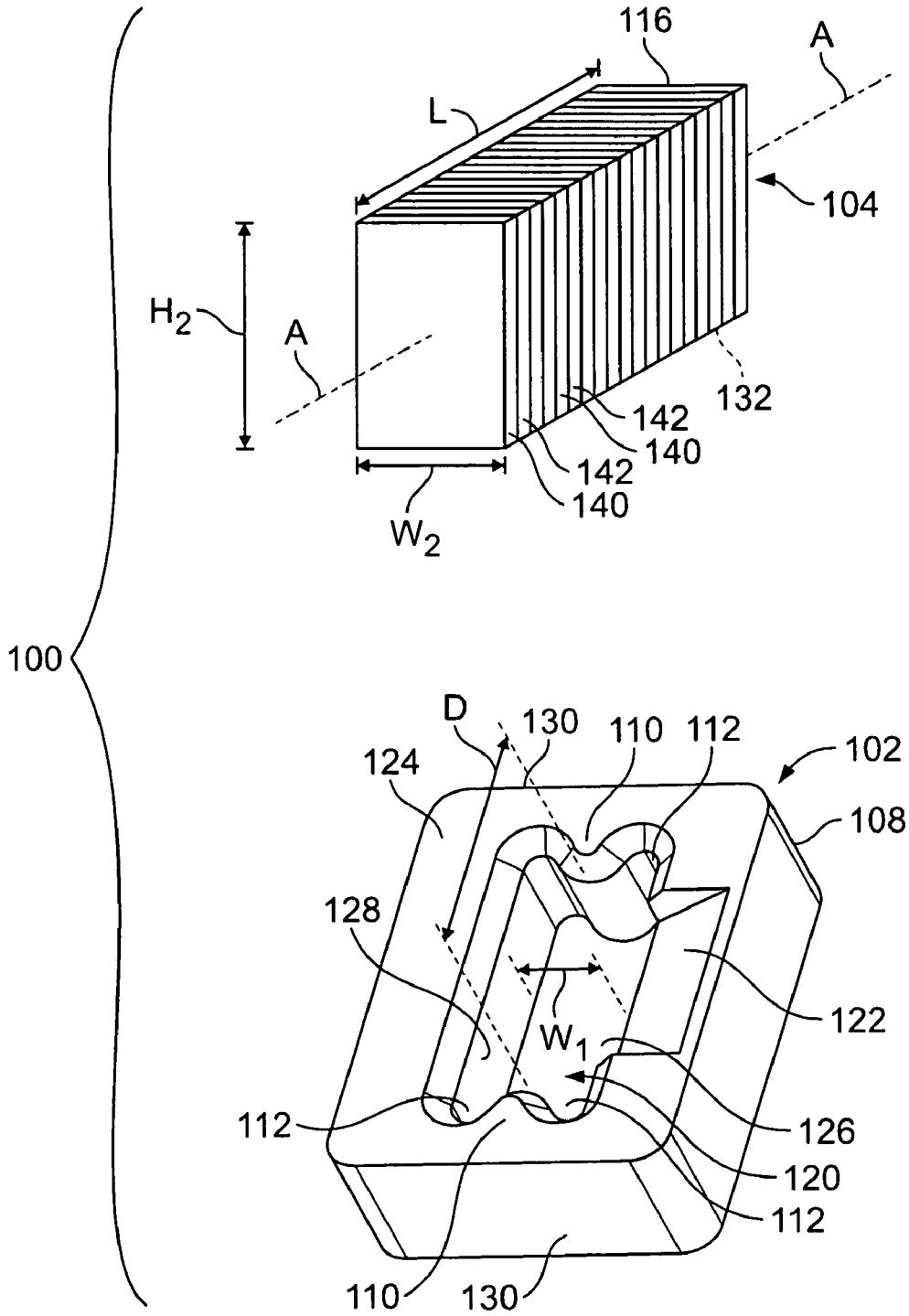
FIG. 2 is an exploded view of the elastomeric connector shown in FIG. 1.

FIG. 2 is an exploded view of the elastomeric connector 100. The body 108 includes a pocket 120 that receives the elastomeric member 104. The positioning ribs 110 are formed at opposite ends of the pocket 120, a distance D apart. The pocket 120 has a width $W_1$. A receiving area 122 is provided in the body 108 for the admission of an adhesive into the holder 102. In one embodiment, the receiving area 122 is in the form of a ramped section or bevel formed in, and open to, an upper surface 124 of the holder body 108. The pocket 120 includes a closed bottom 126 and a side wall 128 that completely surrounds the pocket 120 and defines the positioning ribs 110 and the relief areas 112. In one embodiment, the positioning ribs 110 and the relief areas 112 are located proximate end sections 130 of the holder 102. The relief areas 112 are recessed from the positioning ribs 110 toward the end sections 130 such that the positioning ribs 110 and relief areas 112 form M shapes in the side wall 128. In alternative embodiments, other geometries for the positioning ribs 110 and relief areas 112 are also contemplated.

The holder 102 includes a surface that is at least partially electrically conductive. In an exemplary embodiment, the holder 102 is molded from a platable plastic material and plated with a conductive material to provide surfaces that are at least partially conductive. In some embodiments, the holder 102 may be plated over its entire surface. In an alternative embodiment, the holder 102 may be stamped and formed from metal.

The elastomeric member 104 is a conductive member that has a height $H_2$ between a first or upper contact surface 116 and a second or lower contact surface 132 that is opposite the first contact surface 116. The elastomeric member 104 has a length L that is approximately the same as the distance D between the positioning ribs 110 in the holder 102 and a width $W_2$ that is approximately the same as the width $W_1$ of the pocket 120 in the holder 102. The elastomeric member 104 is substantially rectangular in shape, although it is to be appreciated that other shapes may be formed in other embodiments. The elastomeric member 104 includes a plurality of conductive layers 140 together with a plurality of nonconductive layers 142. The conductive layers 140 are separated from one another by nonconductive layers 142. Each of the conductive and nonconductive layers 140 and 142, respectively, is substantially perpendicular to a longitudinal axis A through the elastomeric member 104. In an alternative embodiment, however, the conductive layers 140 and nonconductive layers 142 may extend at other orientations, including parallel, with respect to the longitudinal axis A.

The nonconductive layers 142 separate the conductive layers 140, so that discrete current paths are formed through the individual conductive layers 140 between the upper contact surface 116 and the lower contact surface 132 enabling current flow therebetween while the nonconductive layers 142 prevent current leakage between the conductive layers 140. In an exemplary embodiment, the nonconductive layers 142 are fabricated from a known dielectric or insulating material, such as silicone rubber, and the conductive layers 140 are fabricated from a known particle filled or impregnated silicone elastomer. The elastomeric member 104 may include any number of conductive layers 140 and nonconductive layers 142 as called for in a given application. Further, each conductive layer 140 may include sublayers of conductive material, and each nonconductive layer 142 may include sublayers of nonconductive material. In alternative embodiments, the conductive layers and nonconductive layers 140 and 142 may be formed into the same or different thicknesses from one another. Further, when the connector 100 is used as one contact, the elastomeric member 104 may include a single block of conductive material.

The elastomeric member 104 is loaded into and bonded to the pocket 120 of the holder 102 after the holder 102 is plated so that the elastomeric member 104 and the holder 102 form a conductive unit. The bottom 126 and the side wall 128 of the pocket 120 are at least partially conductive. When the elastomeric member 104 is loaded into the pocket 120, the conductive layers 140 of the elastomeric member 104 electrically engage at least one of the bottom 126 and the side wall 128 of the pocket 120. The elastomeric member 104 is loaded into the pocket 120 in the holder body 108 between the positioning ribs 110 which locate the elastomeric member 104 in the pocket 120. The relief areas 112 in the holder body 108 enable low force deflection of the elastomeric member 104. The elastomeric member 104, though deformable, is only minimally compressible. The relief areas 112 provide space into which the elastomeric member 104 can flow when deflection forces are applied to the elastomeric member 104.

Figure 3:
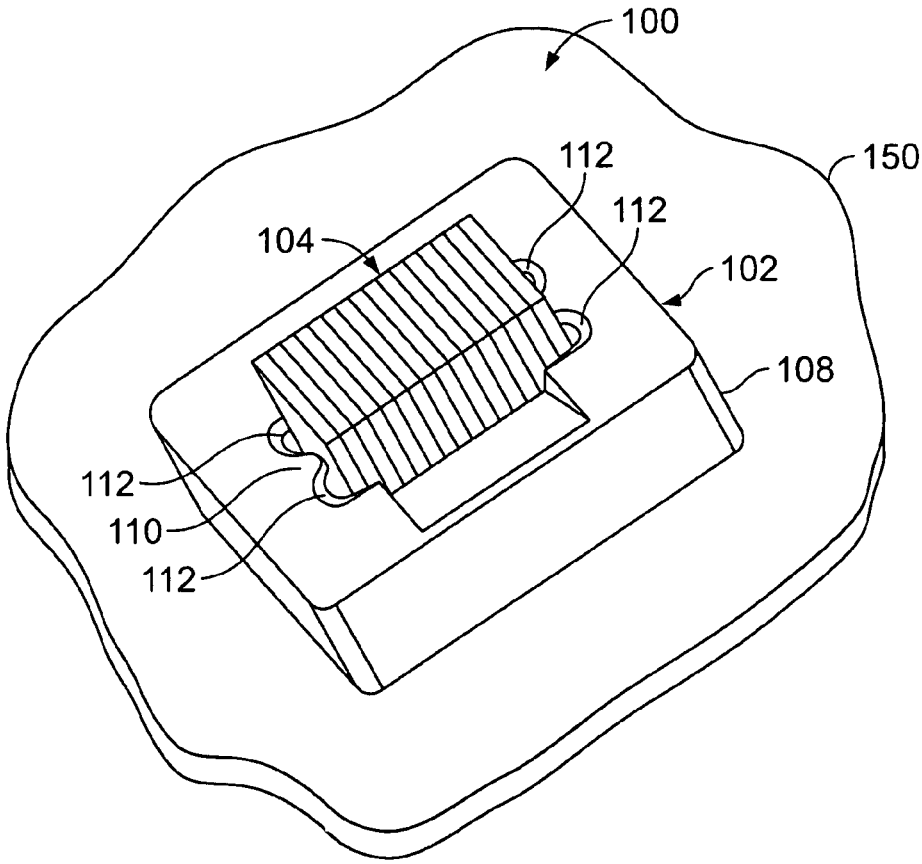
FIG. 3 is a perspective view of the bonded elastomeric connector mounted on a circuit board.

FIG. 3 is a perspective view of the bonded elastomeric connector 100 mounted on a circuit board 150. In an exemplary embodiment, the elastomeric member 104 is mounted in and bonded to the holder 102 which is reflow soldered to the circuit board 150 to mechanically and electrically connect the holder 102 to the circuit board 150. The elastomeric member 104 is electrically connected to the holder 102. When mounted on the circuit board 150, the connector 100 provides a current flow path from a mating circuit board (not shown) through the elastomeric member 104, to the holder 102, and to the circuit board 150. The relief areas 112 in the holder 102 enable the connector 100 to provide a low force connection between the circuit board 150 and the mating board (not shown). The height $H_1$ of the connector 100 is determined by and can be varied by adjusting the height $H_2$ of the elastomeric member 104. As illustrated in FIG. 3, the connector 100 is configured to make one contact or connection. In an exemplary embodiment, the connector 100 has a height $H_1$ of about 2.25 millimeters and may be used, as an example, to provide a grounding or shorting connection between circuit boards in a cellular phone. In alternative embodiments, the connector may be configured to provide multiple contacts as described below.

Figure 4:
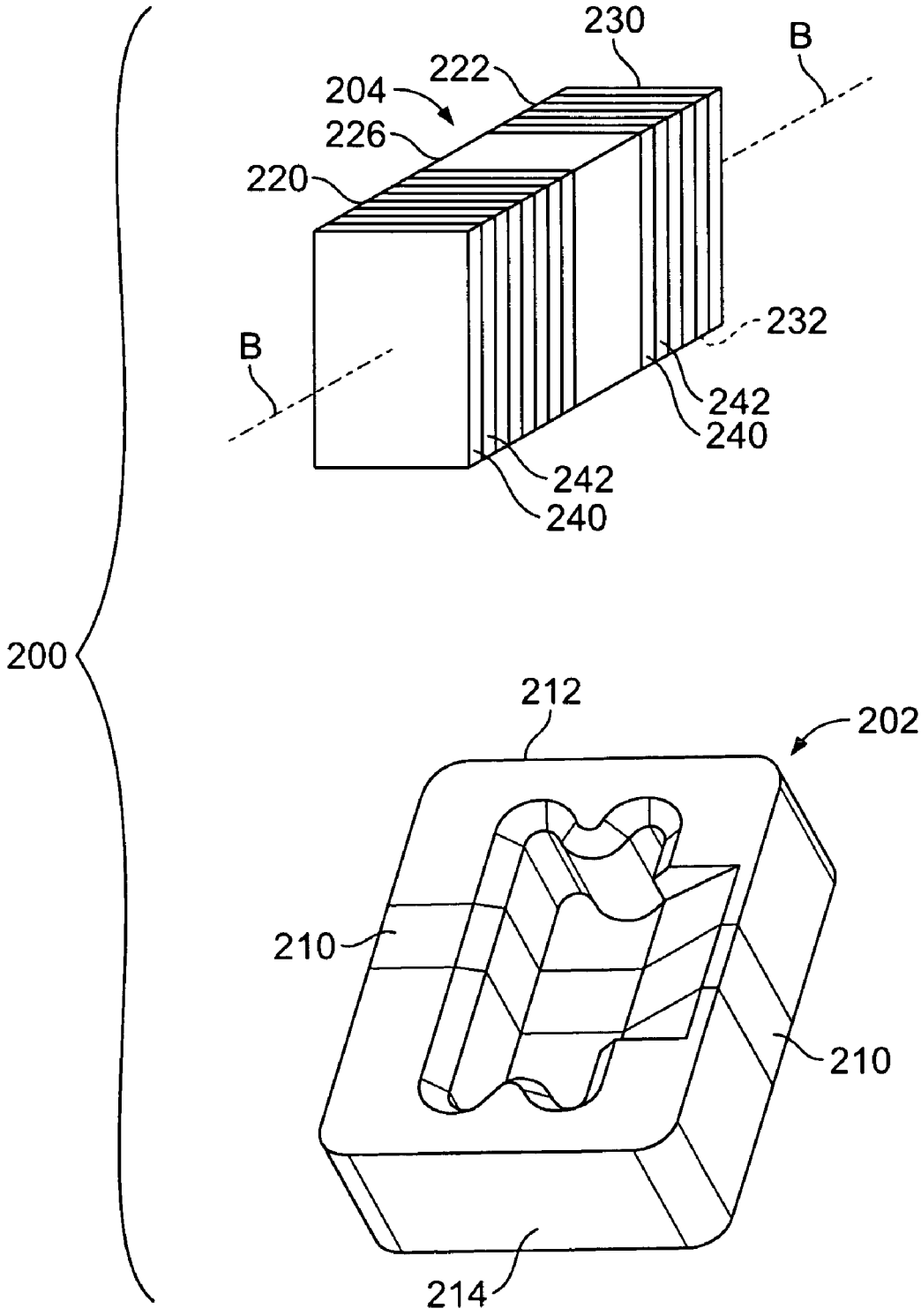
FIG. 4 is an exploded view of an elastomeric connector formed in accordance with an alternative embodiment of the present invention.

FIG. 4 is an exploded view of an elastomeric connector 200 formed in accordance with an alternative embodiment of the present invention. The connector 200 includes a holder 202 and an elastomeric member 204. The holder 202 and the elastomeric member 204 are similar to the previously described holder 102 and elastomeric member 104 and the detailed description of the holder 202 and elastomeric member 204 will be limited to the differences from the previously described embodiment.

The connector 200 is configured to provide two contacts or connections between two circuit boards (not shown). The holder 202 is molded with a ribbon of non-platable plastic 210 between end sections 212 and 214 which are molded from platable plastic such that when the holder 202 is plated, two conductive portions 212 and 214 are formed separated by a nonconductive section at the ribbon of non-platable plastic 210.

The elastomeric member 204 includes a first conductive element 220 and a second conductive element 222 that are separated by an isolating section 226. The conductive elements 220 and 222 and the isolating section 226 extend between a common first or upper contact surface 230 and a common second or lower contact surface 232. Each conductive element 220 and 222 includes a plurality of conductive layers 240 together with a plurality of nonconductive layers 242. The conductive layers 240 are separated from one another by nonconductive layers 242. Each of the conductive and nonconductive layers 240 and 242, respectively, is substantially perpendicular to a longitudinal axis B through the elastomeric member 204. The isolating section 226 is similarly oriented. In an alternative embodiment, the conductive layers and nonconductive layers 240 and 242 may extend at other orientations, including parallel, with respect to the longitudinal axis B on either side of the isolating section 226.

The conductive elements 220 and 222 provide separate current paths through the elastomeric member 204 between the first contact surface 230 and the second contact surface 232. When mounted and bonded in the holder 202, the conductive elements 220 and 222 are positioned and aligned with the conductive end sections 212 and 214 of the holder 202. The isolating section 226 of the elastomeric member 204 is positioned and aligned with the non-platable ribbon 210 in the holder 202 such that the bonded connector 200, as illustrated in FIG. 4 provides two contacts or connections. It is to be understood, however, that in other embodiments, other numbers of contacts may be provided to meet application requirements.

In a two contact configuration, such as the connector 200, the two contacts of the connector may be used, as an example, to provide a positive and a negative contact combination to support speaker, ringer, or vibration motor connections in cellular phones.

The embodiments thus described provide a low profile, low cost connector that is an easily customizable alternative to a pogo pin connector for making electrical connections between two substrates. The connector provides a low force connector solution that is reflow solderable to a circuit board. The combination of the elastomeric member and plated plastic holder provides a low profile, inexpensive, connector that may be customized with no tooling and may be produced with a short lead time.

While the invention has been described in terms of various specific embodiments, those skilled in the art will recognize that the invention can be practiced with modification within the spirit and scope of the claims.

The invention claimed is:

1. An electrical connector comprising:

a holder having a base configured to be mounted on and electrically connected to a circuit board, said holder having a pocket and having opposed end sections and opposed side walls formed integral with one another and completely surrounding said pocket, one of said side walls and end sections having a conductive surface; and a conductive elastomeric member mounted in said pocket and electrically connected to said conductive surface of said pocket, said end sections and side walls completely surrounding said elastomeric member, said conductive surface being configured to convey electrical current between said elastomeric member and said base of said holder to the circuit board.

2. The connector of claim 1, wherein said pocket includes a relief area formed therein to facilitate deflection of said elastomeric member within said holder.

3. The connector of claim 1, wherein said pocket has a closed bottom that includes said conductive surface to electrically couple said elastomeric member to said pocket, said closed bottom formed integral with said end sections and said side walls, said closed bottom forming a part of the base, said closed bottom being configured to be mounted on the circuit board.

4. The connector of claim 1, wherein said holder is fabricated from a nonconductive plateable material that is at least partially plated with a conductive material to provide said conductive surface.

5. The connector of claim 1, wherein said holder includes a receiving area open to an upper surface of said holder to receive an adhesive.

6. The connector of claim 1, wherein at least one of said side walls has said conductive surface to electrically couple said pocket to said elastomeric member.

7. The connector of claim 1, wherein said elastomeric member comprises a plurality of conductive layers and nonconductive layers in an alternating arrangement, and wherein said conductive surface is provided on one of said side walls, said conductive layers electrically engaging said conductive surface on one of said side walls.

8. The connector of claim 1, wherein said holder includes first and second conductive said end sections separated by a nonconductive ribbon and said elastomeric member includes first and second conductive elements separated by an isolating section, said isolating section being aligned with said nonconductive ribbon when said elastomeric member is mounted in said holder.

9. An electrical connector comprising:

a holder having a base that is configured to be mounted on and electrically connected to a circuit board, said holder including a side wall and a closed bottom formed integral with one another and shaped to define a pocket, one of said side wall and closed bottom having a conductive surface, said side wall having a relief area formed therein, said closed bottom being configured to be mounted on the circuit board; and a conductive elastomeric member mounted in said pocket and on said closed bottom, said relief area facilitating deflection of said elastomeric member within said pocket, said conductive surface being configured to convey electrical current between said elastomeric member and the circuit board.

10. The connector of claim 9, wherein said holder includes opposed end sections and opposed side walls that are formed integral with one another and entirely surrounds said pocket, said end sections and side walls being formed integral with said closed bottom, said conductive surface being provided on at least one of said closed bottom and said side wall.

11. The connector of claim 9, wherein said holder is fabricated from a nonconductive plateable material that is at least partially plated with a conductive material to provide said conductive surface on said pocket.

12. The connector of claim 9, wherein said holder includes a receiving area open to an upper surface of said holder to receive an adhesive, said relief area extending from said upper surface to said closed bottom.

13. The connector of claim 9, wherein said elastomeric member is bonded to said holder.

14. The connector of claim 9, wherein said elastomeric member comprises a plurality of conductive layers and nonconductive layers in an alternating arrangement, and wherein said closed bottom includes said conductive surface thereon, said conductive layers electrically engaging said conductive surface on said closed bottom.

15. The connector of claim 9, wherein said holder includes first and second conductive end sections separated by a nonconductive ribbon and said elastomeric member includes first and second conductive elements separated by an isolating section, said isolating section being aligned with said nonconductive ribbon when said elastomeric member is mounted in said holder.

16. The connector of claim 9, wherein said base of said holder is configured to be reflow solderable to a circuit board.

17. The connector of claim 1, wherein holder further comprises a closed bottom in said pocket, said closed bottom being located between said elastomeric member and the circuit board on which the holder is to be mounted.

18. The connector of claim 9, wherein said closed bottom is located between said elastomeric member and the circuit board to which the holder is to be mounted.

19. The connector of claim 3, wherein said elastomeric member includes upper and lower contact surfaces, said lower contact surface engaging said closed bottom of said holder, said upper contact surface being configured to electrically engage a second circuit board.

20. The connector of claim 9, wherein said elastomeric member includes upper and lower contact surfaces, said lower contact surface engaging said closed bottom of said holder, said upper contact surface being configured to electrically engage a second circuit board.

* * * * *